United States Patent [19]

Rogers

[11] 4,185,187

[45] Jan. 22, 1980

[54] ELECTRIC WATER HEATING APPARATUS

[76] Inventor: David H. Rogers, 1210 Gateway Rd., Lake Park, Fla. 33403

[21] Appl. No.: 825,380

[22] Filed: Aug. 17, 1977

[51] Int. Cl.[2] ..... H05B 1/02; H05B 3/82; F24H 1/10

[52] U.S. Cl. ..... 219/306; 219/309; 219/331; 219/332; 219/496; 222/146 HE

[58] Field of Search ..... 219/296–309, 219/332, 496, 331, 327; 137/341; 222/146 HE; 239/133, 135, 136

[56] References Cited

U.S. PATENT DOCUMENTS

| | | | |
|---|---|---|---|
| 1,196,487 | 8/1916 | Simon | 219/309 |
| 1,558,823 | 10/1925 | Bayne | 219/299 |
| 1,920,284 | 8/1933 | Wells | 219/306 X |
| 1,965,208 | 7/1934 | Ackerman | 219/306 |
| 2,263,833 | 11/1941 | Aldrich | 219/306 UX |
| 2,419,429 | 4/1947 | Voiles | 219/306 X |
| 3,261,963 | 7/1966 | Weinstein | 219/309 |
| 3,593,649 | 7/1971 | Novi et al. | 219/306 UX |
| 3,638,619 | 2/1972 | Hall et al. | 219/309 X |
| 3,898,428 | 8/1975 | Dye | 219/306 X |

FOREIGN PATENT DOCUMENTS

| | | | |
|---|---|---|---|
| 579942 | 7/1959 | Canada | 219/306 |
| 985962 | 3/1965 | United Kingdom | 219/309 |

*Primary Examiner*—A. Bartis

*Attorney, Agent, or Firm*—Clarence A. O'Brien; Harvey B. Jacobson

[57] ABSTRACT

Under full flow conditions circulated water is conducted for heating through an elongated vertical chamber by a pump along a down-flow path from an upper lateral inlet to a lower outlet and in surrounding relationship to a vertically disposed electrical heating element in the chamber. The chamber is defined by a housing dimensioned to conduct flow with substantially no storage of water therein in order to progressively elevate the water temperature as the water is circulated through the chamber. The heating element extends upwardly from the lower axial end of the housing and terminates substantially at the level of the bottom of the inlet. Operation of the heating element is controlled by a thermostat and a flow responsive control both mounted on the upper axial end of the housing so that the heating element is energized only during periods of flow at a predetermined flow rate when the liquid is below a predetermined temperature. In this manner the internal temperature can be maintained at a relatively low value thus enabling the use of synthetic resins and other inexpensive components.

1 Claim, 4 Drawing Figures

TEMPERATURE SENSING SWITCH
72
37
60-RELAY
16
PUMP
20
54
PRESSURE SWITCH ASSEMBLY
40
34
TEMPERATURE SENSING ELEMENT
55
48
28
44
22
26
42
14
30
3
3
32
24
46
36
38
56
12

ELECTRIC WATER HEATING APPARATUS

BACKGROUND OF THE INVENTION

This invention relates of the heating of relatively large bodies of water for swimming pools, water spas, hydrotherapy equipment and whirlpools.

Heating apparatus for water, especially for outdoor use, has been very expensive and wasteful in regard to energy consumption. Often, water heaters store substantial amounts of water, maintained at an elevated temperature, to provide for more rapid heating or fireup. Such heaters must, therefore, be of a large size and involve costly installation and maintenance. It is, therefore, an important object of the present invention to provide a water heater which occupies less space and operated to maintain a desired water temperature by a more efficient expenditure of electrical energy. A further object is to provide a water heater that is easy to install and requires a minimum of maintenance.

SUMMARY OF THE INVENTION

In accordance with the present invention, a vertically elongated plastic housing encloses a chamber through which a downflow of water is conducted in surrounding relation to an electrical heating element extending upwardly from a closure plug at the lower axial end of the housing. A water temperature sensor enclosed in a protective well projects downwardly into the chamber from an upper closure plug at the upper end of the housing on which electrical control components are mounted including a temperature sensor switch assembly, a pressure switch for detecting the presence of water in the chamber under circulation flow pressure, and a relay assembly wired to the heating element at the lower end of the housing. The housing is supported within an outer casing from which inlet and outlet conduit sections extend adjacent the upper and lower ends of the housing. Caps protectively enclose the control components, terminals and wiring at the upper and lower ends of the housing within the outer casing. The housing is constructed of plastic sections arranged and dimensioned to support unrestricted flow at the desired flow rate without any significant reservoir storage space. Electrical current for operating the heating element is supplied through a relay switch in series with the sensor and pressure switches to limit heater operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF DRAWING FIGURES

DETAILED DESCRIPTION OF THE PREFERRED EMBODIMENT

Figure 1:
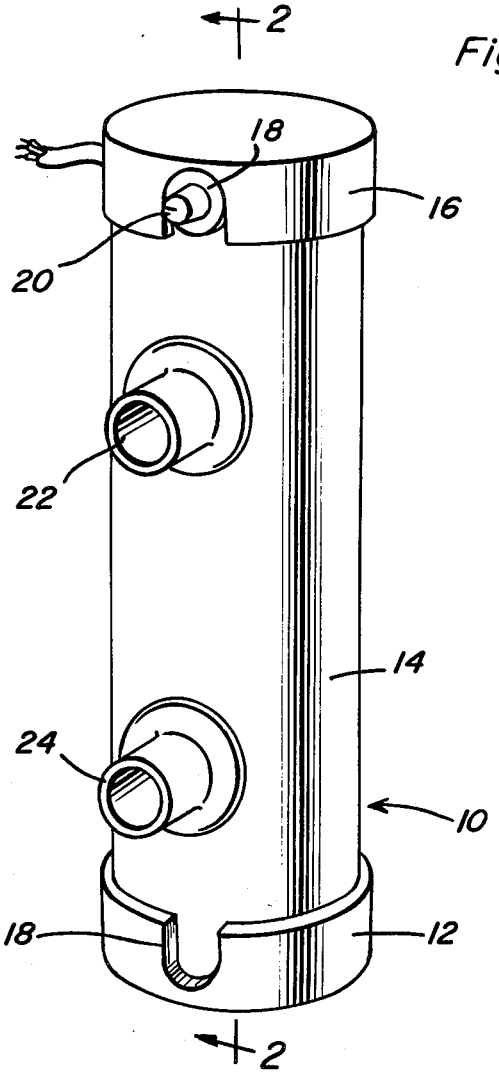
FIG. 1 is a perspective view showing a water heater constructed in accordance with the present invention.
Figure 3:
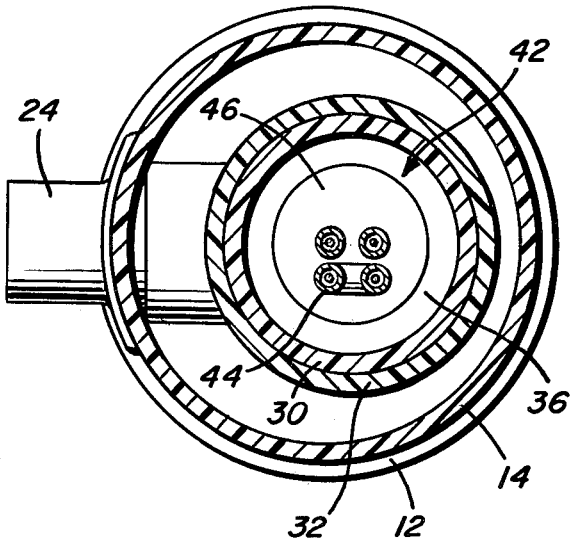
FIG. 3 is a transverse section view taken substantially through a plane indicated by section line 3—3 in FIG. 2.

Referring now to the drawings in detail, FIG. 1 shows a heater constructed in accordance with the present invention, generally denoted by reference numeral 10. The heater is to be mounted on its base cap 12 or permanently anchored in a vertical position to walls, fences, sides of structures or field erected supports. In its installed position, the longitudinal axis of the heater extending through its outer cylindrical casing 14 will be aligned with the vertical. The upper axial end of the casing is closed by a cap 16, opposite the lower base cap 12. The caps 12 and 16 are identical and are each provided with slot 18 so as to expose a temperature control 20 adjacent the upper axial end. Inlet and outlet conduit sections 22 and 24 project from casing 14 adjacent the upper and lower ends, respectively. Water is adapted to be continuously recirculated through the heater between the inlet and outlet conduit sections under a pressure developed by a circulating pump to heat a body of water being serviced by the heater.

Figure 2:
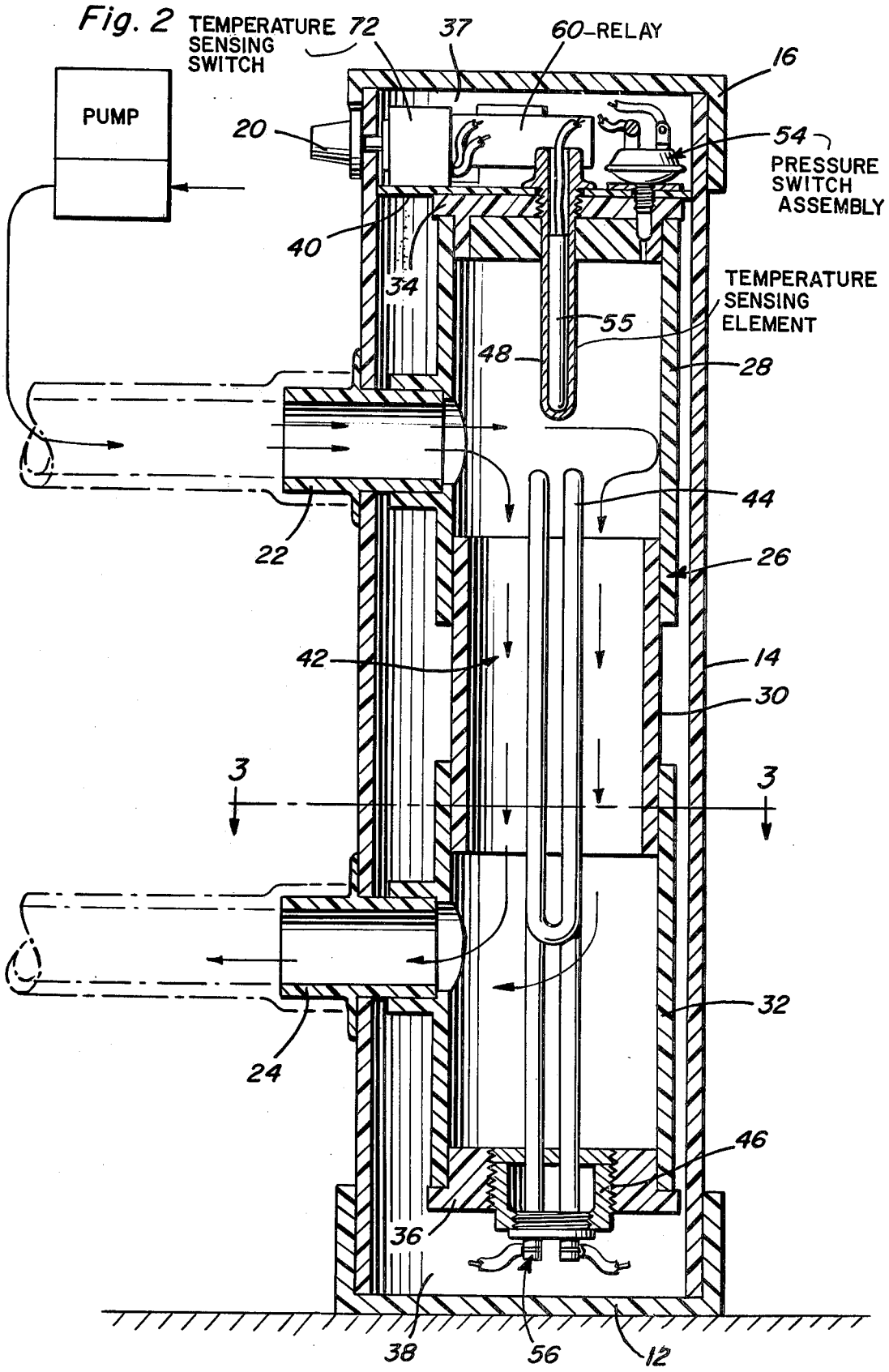
FIG. 2 is a longitudinal section view taken substantially through a plane indicated by section line 2—2 in FIG. 1.

The outer casing 14, caps 12 and 16 and conduit sections 22 and 24 are all made of a suitable, non-corrosive plastic such as polyvinylchloride (PVC). The conduit sections extend from a cylindrical housing assembly generally referred to by reference numeral 26, enclosed within casing 14 as shown in FIG. 2. The upper inlet conduit section 22 is connected to an upper axial section 28 of the housing connected by an intermediate sleeve 30 to a lower axial section 32 to which the lower outlet conduit section 24 is connected. The opposite axial ends of the housing assembly are respectively closed by closure devices 34 and 36. The axial sections, sleeve and closure devices of the housing assembly are also made of PVC or like material. Axial head spaces 37 and 38 are formed within the outer casing 14 between the caps and the internal housing closure devices as shown. A Plexiglass plate 40 encloses the space 37 underlying cap 16 above the upper closure device 34. The housing assembly itself encloses a pressure sealed, cylindrical chamber 42 with which the conduit sections 22 and 24 communicate.

With continued reference to FIG. 2, an "Incaloy" type of electrical heating element 44 is anchored to the closure device 36 by a threaded brass bushing 46 and projects upwardly therefrom centrally along the axial flow path formed within chamber 42. The heating element terminates at the level of the inlet conduit 22 closely spaced from an axially aligned well tube 48 threadedly secured to the closure device 34. The closure device 34 also mounts a pressure sensing switch assembly 54 through which internal pressure within chamber 42 is detected. A temperature sensing element 55 is protectively enclosed in the well tube 48 for monitoring the temperature of the water in chamber 42 and is connected to an Aquastat or temperature sensing switch 72 that is adjusted by means of control 20 aforementioned. The switch 72 is housed within space 37 together with pressure switch assembly 54 and a relay 60. The relay is wired by wiring externally of the housing to the terminal head 56 of the heating element located in space 38 at the lower end of the heater.

Figure 4:
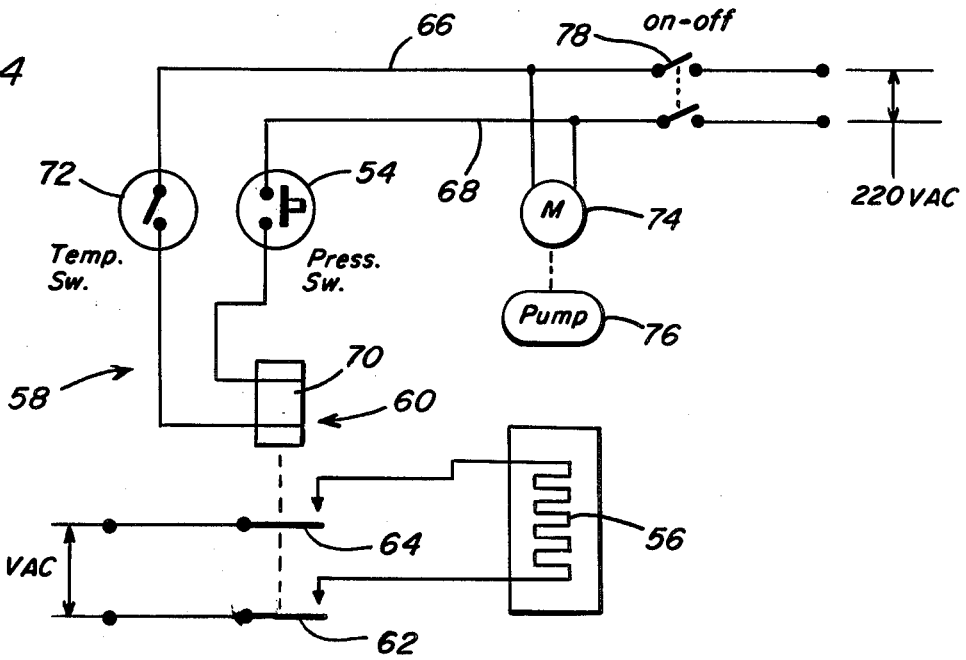
FIG. 4 is a circuit diagram showing the control system associated with the water heater of the present invention.

As shown in FIG. 4, the controls generally referred to by reference numeral 58 include a double pole, single throw type of relay 60, having normally open relay switches 62 and 64 connecting the heater element 56 across power lines 66 and 68 upon energization of relay coil 70. The energizing circuit for the relay coil includes the pressure switch 54 aforementioned and the switch element of the Aquastat or temperature sensing device 72 to which the well mounted temperature sensor 55 is connected. Thus, the temperature and pressure switches 72 and 54 are connected in series with the relay coil across the power lines to limit operation of the heating element to temperature below a maximum 120 degrees F., for example, when water under a circulating pressure is present within chamber 42. A 220 volt A.C. power source may be connected to the power lines for operation of the heater simultaneously with a drive motor 74 for a pump 76 upon closing of power switch 78. The pump 76 will continuously recirculate water between the heater and the body of water being serviced with substantially no significant storage of water in the heater. The chamber 42 will accordingly be dimensioned with the inlet and outlet conduits 22 and 24 to conduct a downflow of water at a predetermined flow rate substantially no significant storage of heated water, in order to heat a relatively large body of water to a desired temperature. For example, with inlet and outlet conduits of $1\frac{1}{2}$ inch diameters, a flow rate of 60 gallons per minute may be handled by the heater 10 in one embodiment of the invention. The applicant's specifically disclosed embodiment of the invention consists of a heater device for use a pump for heating of water in spas, whirlpools and the like. The device is designed to be light in weight and relatively inexpensive to manufacture. In view of the use of inexpensive components, such as the plastic housing, the maximum temperature which may be attained by the device must be limited. If a constant flow of liquid is maintained over the heating element during the times that the heating element is energized, the temperature within the chamber containing the heating element will be maintained at the desired low value. However, if energization of the heating element takes place when no flow of liquid is present for cooling of that element, the entire device may overheat and be destroyed. Consequently, a pressure switch assembly is employed as a means for sensing the pressure within the heat exchange chamber and allowing energization of the heating element only when the pressure in the chamber indicates the existence of the flow of liquid therethrough. Also included in the heat exchange chamber is a temperature sensor which is effective to disconnect the heating element from the electrical source in the event that the temperature within the chamber inadvertently rises to a predetermined undesirable limit. To further enhance the cooling effect of the heating element, the liquid flow is directed downwardly through the heat exchange chamber from an inlet 22 positioned near the top of the device to an outlet 24 positioned proximate to the bottom of the device. This together with the fact that the heating element extends to a position just below the inlet provides for a water flow from the inlet to the distal chamber wall. The water disperses from the wall and is forced axially downward through the chamber and out the outlet. If the water were introduced into the heating chamber in the opposite direction, that is, through 24 rather than 22, the high pressure necessary to produce sufficient volumetric flow for adequate cooling of the heater would cause the formation of vortices when the stream directly contacts the element positioned in the stream. These vortices would produce spots of insufficient cooling on the heater thus producing excessive heat damaging both the heater and the chamber housing. Furthermore, the heating device is positioned in a vertical orientation with the heating element extending from the bottom thereof vertically to the position below the inlet to reduce the deleterious effects of the heat rise along the heating element. If the heating element was disposed in a depending position from the top of the chamber, the heat rise caused by the element could possibly harm the housing to which the element is attached.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A heater for liquid circulated at a predetermined flow rate comprising a synthetic resin housing, said housing being vertically disposed and enclosing an elongated vertical chamber through which said liquid is conducted along an axial path, closure means connected to the housing at the upper and lower axial ends for sealing the chamber, an upper inlet conduit and a lower outlet conduit connected laterally to the housing adjacent the upper and lower ends through which the liquid enters and exits and flows downwardly through the chamber, an electrical heating element mounted on the lower closure means at the lower axial end of the housing and extending upwardly therefrom along said axial path within the chamber toward the inlet conduit and terminating substantially at the level of the botttom of the inlet conduit, temperature sensing means mounted on the upper closure means and projecting axially downwardly into the chamber toward the heating element, pressure switch means mounted on the upper closure means externally of the chamber, said temperature sensing means and pressure switch means energizing the heating element only during periods of flow of the liquid through the chamber when the liquid is below a predetermined temperature, said chamber being dimensioned to conduct said flow at the predetermined flow rate with substantially no significant storage of water in the chamber, an outer casing enclosing the housing, said inlet and outlet conduits projecting from said casing, and cap means connected to the casing in spaced relation to the closure means for protectively enclosing the heating element and the temperature sensing means and pressure switch means within the casing.

* * * * *